US006234050B1

(12) United States Patent
Konen et al.

(10) Patent No.: US 6,234,050 B1
(45) Date of Patent: May 22, 2001

(54) ERGONOMIC HAND TOOL

(75) Inventors: Bruce P. Konen, Aurora; Robert F. Pierson, Rockford, both of IL (US)

(73) Assignee: Ideal Industries, Inc., Sycamore, IL (US)

( * ) Notice: Subject to any disclaimer, the term of this patent is extended or adjusted under 35 U.S.C. 154(b) by 0 days.

(21) Appl. No.: 09/285,972

(22) Filed: Apr. 5, 1999

(51) Int. Cl.[7] ..... B25B 7/00
(52) U.S. Cl. ..... 81/427.5; 81/417
(58) Field of Search ..... 81/427.5, 415, 81/417, 380–409; 30/193, 248, 257, 199

(56) References Cited

U.S. PATENT DOCUMENTS

| | | | | |
|---|---|---|---|---|
| 1,288,079 | * | 12/1918 | McClean | 81/427.5 X |
| 1,428,600 | * | 9/1922 | McCullough | 81/186 X |
| 2,382,606 | * | 8/1945 | Clark | 81/356 |
| 2,523,936 | | 9/1950 | Axelsen . | |
| 2,638,669 | * | 5/1953 | Steede | 30/262 |
| 4,793,224 | * | 12/1988 | Huang | 81/302 |
| 4,934,222 | | 6/1990 | Rittmann et al. . | |
| 5,253,557 | * | 10/1993 | Dolak | 81/427.5 |
| 5,339,712 | * | 8/1994 | Keyvani | 81/416 |
| 5,522,290 | * | 6/1996 | Visser et al. | 81/4.7 X |

OTHER PUBLICATIONS

Clauss Brochure (1 page) , Clauss Fiberoptic/Telcom Division , ©1998.
Torvaal Brochure (3 pages) Chagrin Falls, OH , undated.

* cited by examiner

*Primary Examiner*—D. S. Meislin
(74) *Attorney, Agent, or Firm*—Cook, Alex, McFarron, Manzo, Cummings & Mehler, Ltd.

(57) ABSTRACT

A hand tool such as a wire stipper or pliers has two elongated members pivotably connected at a joint with a pair of facing jaws on one side of the joint and a pair of handles on the other side of the joint. The handles are ergonomically designed for user comfort. One of the handles is curved about a variable radius on one side only of the handle. The other handle has a complex curvature about centers on both sides of that handle. The handles are covered with sleeves that extend on the outside of the handle from the end to the pivot joint.

7 Claims, 2 Drawing Sheets

ERGONOMIC HAND TOOL

SUMMARY OF THE INVENTION

This invention relates to hand tools having a pair of elongated members pivotably connected to one another at a joint in the man of pliers. The elongated members have jaws on one side of the joint and handles on the other side of the joint. The jaws can be equipped to perform a variety of tasks such that the tool may function as a pliers, wire stripper, wire cutter, crimp nest, bolt cutter or some combination of these.

While tools of this general character have been known for generations, more recent design efforts in hand tools have focused on the ergonomics of tools. The desire to increase the productivity of electricians, installers, service technicians and production workers has lead to various handle designs intended to reduce or eliminate fatigue, stress and repetitive motion injuries. An example is found in U.S. Pat. No. 4,934,222. The present invention is similarly directed to a tool design which provides increased user comfort.

The handles of this invention are generally disposed on opposite sides of the jaw axis. A first handle is curved such that it is concave toward a second handle. A user's thumb, base of the thumb and/or lower palm rest against the first handle. The second handle has a multiply-directed curvature such that it is both concave and convex toward the first handle. The convex portion provides a crook for a user's forefinger while the concave portion conforms to the natural shape of the middle through fifth fingers, forming a comfortable grip therefor. A handle sleeve covers each handle to provide a cushioned grip. The edge of the sleeve near the pivot joint of the tool is angled to cover more of the outside edge of the handle.

DETAILED DESCRIPTION OF THE INVENTION

Figure 1:
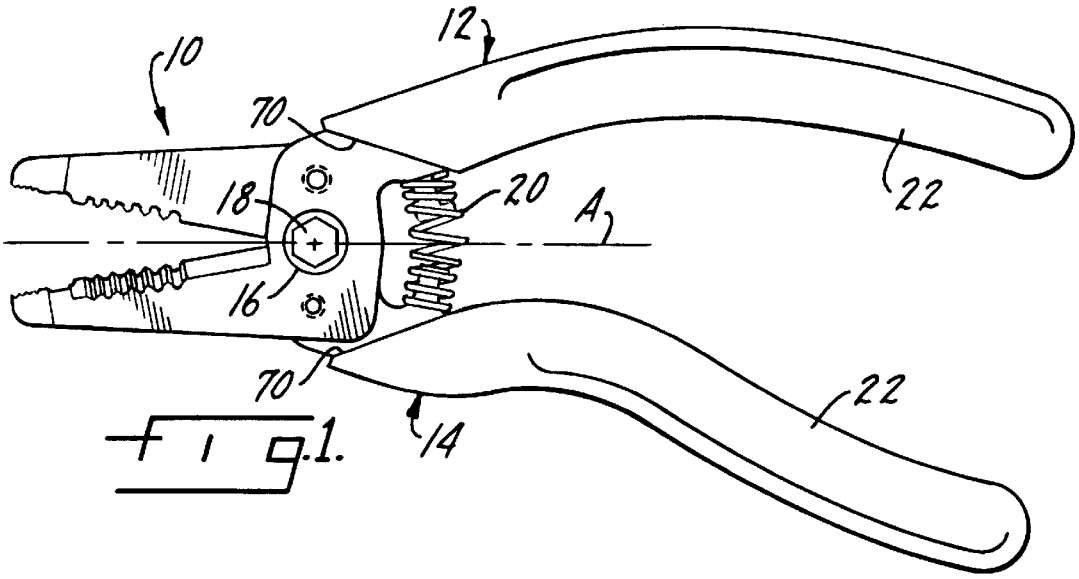
FIG. 1 is a side elevation view of the hand tool of the present invention, including cushion handle sleeves.

A first embodiment of the hand tool of the present invention is shown generally at 10 in FIG. 1. the tool includes the and second elongated members 12 and 14. The elongated members are pivotably connected together at a joint that preferably includes a bushing 16 and a locking screw 18. A nut (not shown but on the opposite side of the tool as seen in FIG. 1) retains the screw 18 in the bushing 16. The joint allows the elongated members to pivot about the joint. A spring 20 biases the elongated members apart. The tool is shown with handle sleeves 22 on the elongated members. The sleeves are made of rubber or plastic or other suitably soft but durable material to provide a cushion for the handles.

Figure 2:
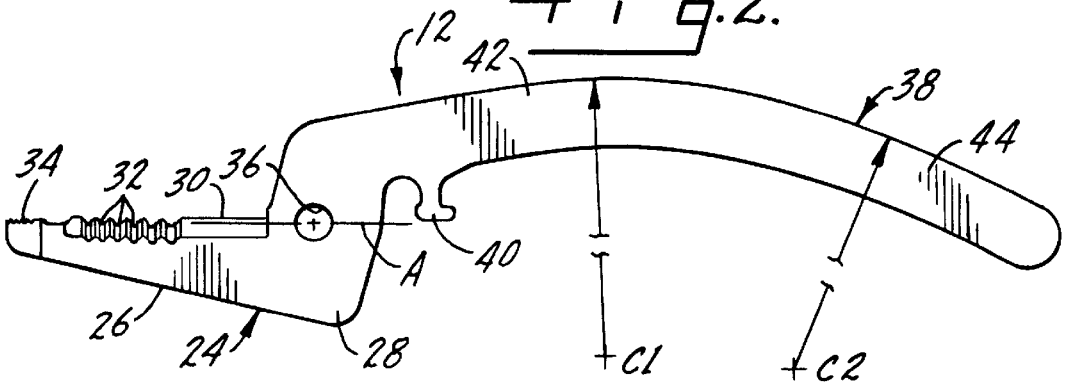
FIG. 2 is a side elevation view of the first elongated member, with the cushion handle sleeve removed.

The first elongated member 12 is shown in FIG. 2. It includes a jaw 24. The jaw has a blade section 26 and a base section 28 that extends at an angle to the blade section. Along one edge of the blade there is formed a wire cutting edge 30, a series of wire stripping grooves 32 and a nose 34 forming a gripping portion. The nose is offset somewhat from the plane of rest of the blade. The base section 28 has a bore 36 through it for receiving the bushing 16 and locking screw 18. Extending from the base 28 is a first handle 38. A generally T-shaped post 40 protrudes from the handle for mounting the spring 20.

A jaw axis A is defined by the jaw 24 and a similar jaw 46 of the second elongated member 14. The jaw axis A bisects the angle formed by appropriate reference lines defined by the jaws 24 and 46. The reference line may vary according to the particular arrangement of the jaws. The reference line could be a line of contact between the jaws or a line connecting a grinding datum point, such as at 41, with the joint center. The reference line might be defined by the cutting edges 30 and 52. In any case the jaw axis extends through the center of the joint 16, 18.

The first handle 38 has a compound, simplex curvature. By compound it is meant that the radius of curvature of the handle is variable. In the preferred embodiment the first handle has a first portion 42 adjacent the base section 28 with a radius of curvature of about 4 inches. A second portion 44 of handle 38 adjoins the first portion 42 and has a radius of curvature of about 10 inches. By simplex it is meant that the center or centers of curvature are on the same side of the first handle. In this case there are two centers of curvature C1 and C2. Both of them are on the lower (as seen in FIG. 2) side of the first handle, i.e., the side of the jaw axis A. Thus, the first handle is concave toward the second handle. It terminates on or near the jaw axis.

Figure 3:
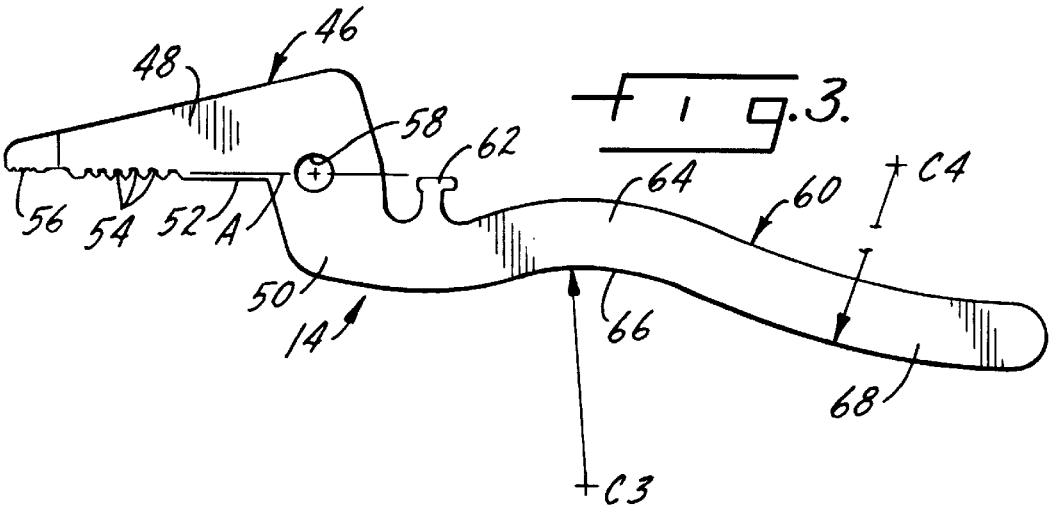
FIG. 3 is a side elevation view of the second elongated member, with the cushion handle sleeve removed.

The second elongated member 14 is shown in FIG. 3. It includes a jaw 46 having a blade section 48 and a base section 50 similar to those of the first elongated member. Once again an edge of the blade 48 carries a wire cutting edge 52, a series of wire stripping grooves 54 and a nose 56 forming a gripping portion. The nose is offset somewhat from the plane of the rest of the blade. The edge, grooves and nose mate with their counter-parts on the first jaw 24 to perform wire cutting, stripping and gripping functions. The base section 50 has a bore 58 through it for receiving the bushing 16 and locking screw 18. Extending from the base 28 is a second handle 60. A generally T-shaped post 62 protrudes from the handle for mounting the spring 20.

The second handle 60 has a complex curvature. In the preferred embodiment the second handle has a first portion 64 adjacent the base section 50 with a radius of curvature of about 1.5 inches. This comparatively tight radius forms a crook 66. A second portion 68 of handle 60 adjoins the first portion 64 and has a radius of curvature of about 6 inches. By complex curvature it is meant that there are at least two centers of curvature and there are centers of curvature on different sides of the handle. In this case there are two centers of curvature C3 and C4. Center C3 is on the lower (as seen in FIG. 3) side of the second handle, i.e., the side opposite the jaw axis A. Center C4 is on the upper (as seen in FIG. 3) side of the second handle, i.e., the side of the jaw axis A. Thus, the second handle is both convex and concave toward the first handle.

The shape of the second handle allows a user's forefinger to engage the crook 66 while the middle through fifth fingers rest on the outside of the second portion 68. The crook provides a solid contact for the forefinger, allowing the strength of the forefinger to be fully applied to the second handle without slipping up or down the handle. The second portion of the second handle conforms well to the middle through fifth fingers. Meanwhile, the curved first handle rests against the thumb, the base of the thumb, and/or the lower portion of a user's palm, depending on how the user grabs the tool. It has been found that what tends to happen as the user squeezes the handles together is the tool rolls or pivots somewhat against the palm or lower thumb area. The curved first handle allows this rolling action with maximum comfort while the complex curve of the second handle accommodates maximum squeezing power.

Another aspect of the invention is the arrangement of the handle sleeves 22. The edge of the sleeves near the pivot joint is angled as at 70 to provide maximum coverage of the handle. It will be noted that the extent of each sleeve 22 on the inside edge of the handles, i.e., the edge adjacent the jaw axis A, is limited by the spring posts 40 and 62. But the outside edge of the handle is not so obstructed. The sleeves of the present invention take advantage of this fact. With the angled edge 70 of the sleeves 22 the outside edge of the handle is covered all the way to the base sections 28 and 50. There are some applications where the tool will be gripped near the base sections and this extended sleeve portion will provide extra comfort to the user.

Figure 4:
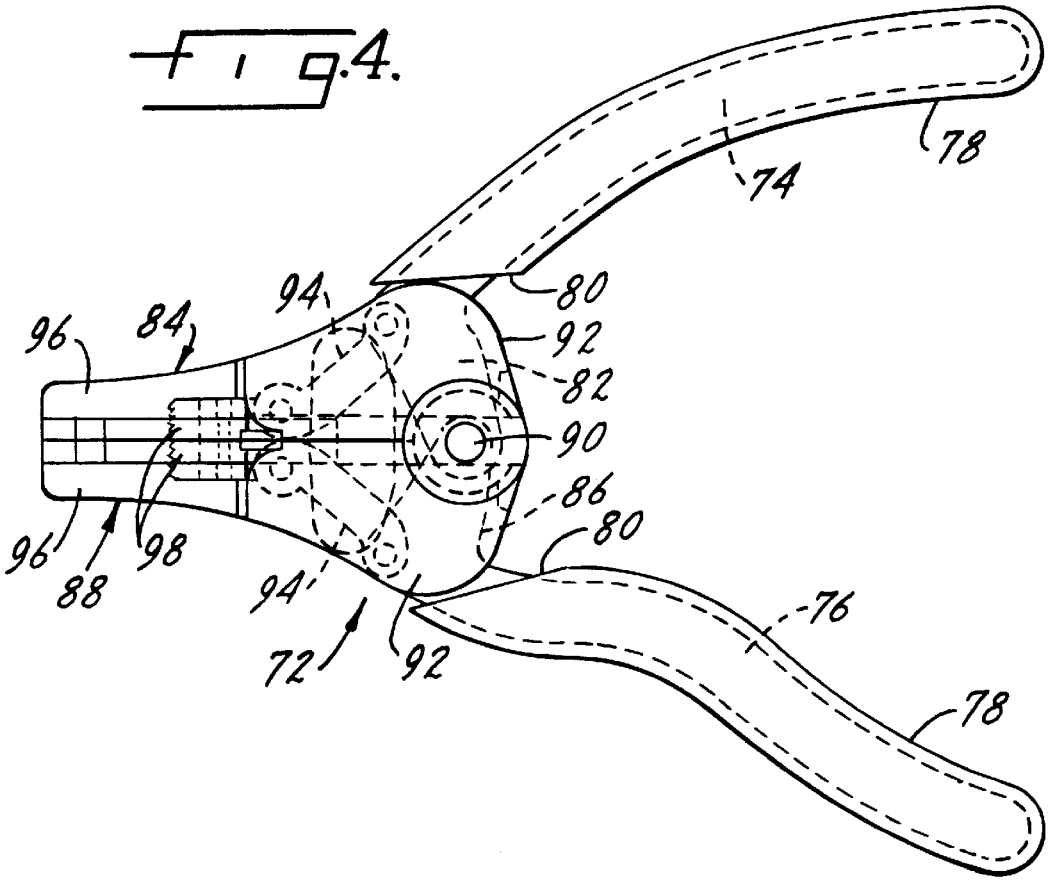
FIG. 4 is a side elevation view of a second embodiment of a hand tool having the handles of the present invention.
Figure 5:
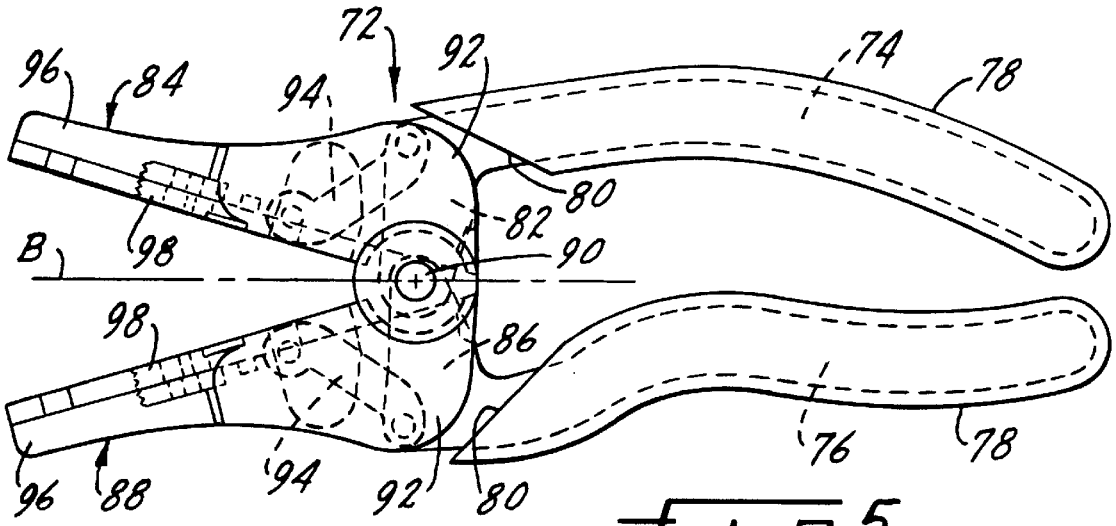
FIG. 5 is a side elevation view of the tool of FIG. 4, showing the tool in the actuated condition.

FIGS. 4 and 5 illustrate that the handle and sleeve designs of the present invention can be used with different jaw configurations. The jaws of this embodiment form a wire stripper 72 generally built in accordance with U.S. Pat. No. 2,523,936, the disclosure of which is incorporated herein by reference.

The tool 72 has a first handle 74 which, as the first handle 38, has a compound, simplex curvature. Thus, the radius of curvature of the handle 74 is variable and the centers of curvature are on the same side of the first handle. In this case the centers of curvature are on the left (as seen in FIGS. 4 and 5) side of the first handle 74, i.e., the side of the jaw axis B and the first handle is concave toward the second handle 76. The second handle 76 is similar to second handle 60 in that it has a complex curvature. Thus, it has at least two centers of curvature and there are centers of curvature on different sides of the handle. In this case there are two centers of curvature and the second handle is both convex and concave toward the first handle 74.

Each handle 74 and 76 is covered by a handle sleeve 78. As in the case of sleeves 22, sleeves 78 have angled edges 80 which permit the sleeve to cover the full extent of the outside edge of the handles even though the inside edge is somewhat shorter than the of outside edge.

First handle 74 is connected to a jaw that comprises an integral base section 82 and a blade section 84. The base section 82 is integrally formed at one end of the handle 74. The second handle is also connected to a jaw having a similar construction including a base section 86 and a blade section 88. The two base portions 82 and 86 have bores therethrough which receive a bolt 90 to form a joint about which the handles can pivot. Briefly, the blade sections 84 and 88 are multiple-part mechanisms including frame portions 92, links 94, cutter supports 96 and cutter elements 98. Further details of these mechanisms are described in U.S. Pat. No. 2,523,936. Squeezing the first and second handles together first causes the cutter elements to close on a wire, severing an insulation slug. This is followed by separation of the jaw sections, seen in FIG. 5, which effects stripping of the insulation slug from the wire. The improved handles of the present invention permit this action with increased comfort for the user.

While a preferred form of the invention has been shown and described, it will be realized that alterations and modifications may be made thereto without departing from the scope of the following claims.

What is claimed is:

1. A hand tool, comprising first and second elongated members pivotably connected at a joint, the first and second elongated members respectively comprising first and second handles on one side of the joint and first and second jaws on the other side of the joint, the first handle having a simplex curvature throughout its length and the second handle having a complex curvature, the first and second jaws defining a jaw axis and the handles being substantially disposed on opposite sides of the jaw axis, the second handle having a first portion adjacent the joint and a second portion which adjoins the first portion, the first portion being curved about a center on the side of the second handle opposite the jaw axis, and the second portion being curved about a center on the same side of the second handle as the jaw axis and wherein said first portion has a radius of about 1.5 inches and the second portion has a radius of about 6 inches.

2. The hand tool of claim 1 further characterized in that the first handle has a compound curvature.

3. The hand tool of claim 1 wherein the first handle terminates substantially on the jaw axis.

4. The hand tool of claim 1 wherein the first handle is concave toward the second handle.

5. The hand tool of claim 1 further comprising a spring biasing the handles apart.

6. The hand tool of claim 1 wherein the handles each have an inside edge adjacent the jaw axis and an outside edge on the side opposite the inside edge, and further comprising sleeves on the handles, the sleeves extending a greater length on the outside edge than on the inside edge to a point adjacent the joint.

7. A hand tool, comprising first and second elongated members pivotably connected at a joint, the first and second elongated members respectively comprising first and second handles on one side of the joint and first and second jaws on the other side of the joint, the first handle having a simplex curvature throughout its length and the second handle having a complex curvature, the first and second jaws defining a jaw axis and the handles being substantially disposed on opposite sides of the jaw axis and wherein the first handle has a first portion adjacent the joint and a second portion which adjoins the first portion, both the first and the second portions being curved about centers on the same side of the first handle as the jaw axis and wherein said first portion has a radius of about 4 inches and the second portion has a radius of about 10 inches.

* * * * *